United States Patent [19]

Nelson

[11] 4,284,128

[45] Aug. 18, 1981

[54] AIR CONDITIONER AND HEAT DISPENSER

[76] Inventor: Donald A. Nelson, 5755 S. Village Way, Ogden, Utah 84403

[21] Appl. No.: 86,343

[22] Filed: Oct. 19, 1979

[51] Int. Cl.[3] ..... F25B 29/00

[52] U.S. Cl. ..... 165/48 R; 165/59; 165/60; 62/DIG. 16; 62/315; 261/29; 261/151; 261/161

[58] Field of Search ..... 62/259, 314, 315, 309, 62/DIG. 16, 304, 305; 165/19, 48, 59, 60, 122; 261/29, 151, 161

[56] References Cited

U.S. PATENT DOCUMENTS

| | | | |
|---|---|---|---|
| 2,725,729 | 12/1955 | Mills | 261/151 |
| 2,766,597 | 10/1956 | Gieck | 62/315 |
| 4,043,777 | 8/1977 | Parrer | 165/47 |
| 4,107,942 | 8/1978 | Fairman | 62/305 |
| 4,204,409 | 5/1980 | Satama | 62/305 |

*Primary Examiner*—Albert W. Davis
*Assistant Examiner*—Margaret A. Focarino
*Attorney, Agent, or Firm*—A. Ray Osburn

[57] ABSTRACT

In an evaporation type air cooler, the improvement comprising a heat exchanger wherein circulating liquid is cooled by the evaporatively cooled air and subsequently used to air condition occupant space without humidity increase, and associated air ducting and flow controls. The improvement is also adapted to be used as a space heater utilizing hot water in the heat exchanger, and to utilize hot attic or external air to aid in heating water for occupant use.

15 Claims, 6 Drawing Figures

AIR CONDITIONER AND HEAT DISPENSER

BACKGROUND OF THE INVENTION

1. Field

The field of the invention is air temperature conditioners and more particularly those involving evaporative air coolers in conjunction with heat exchangers.

2. Prior Art

Evaporative air coolers are commonly used to cool buildings in geographical areas having low atmospheric humidity, and generally comprise a low pressure, high capacity air blower which draws hot, dry external atmospheric air through a water soaked pad to cool it by evaporation, and outlet ducting discharging the cooled air into living areas, interior work areas or the like. Such devices provide economical air cooling, but at the expense of increased humidity in the cooled air. Further, such devices have no utility in winter months when the need is for heating, rather than cooling, the air in occupied spaces. Such devices also do not provide for displacement of unwanted hot attic air in dwellings, nor for utilization of the heat in such air. U.S. Pat. No. 4,043,777 discloses an attic exhaust unit comprising an auxiliary exhaust blower and associated exhaust ducting packaged with such an evaporative pad cooler. U.S. Pat. No. 3,630,271 discloses an evaporatively cooled heat exchanger with an associated water loop to exchange heat with separately powered room air conditioners which may be used for heating or cooling. The evaporative cooler is not adapted for direct conditioning of air for living spaces. None of these prior art devices provide for heating and cooling of living space air, the latter without humidity increase, by direct use of a simple combination of evaporative coolers and heat exchangers.

BRIEF SUMMARY OF THE INVENTION

With the foregoing in mind, the invention provides, in an evaporative air temperature conditioning device comprising an air blower normally used to draw outside air through one or more air permeable, water impregnated pads and to then drive the air through outlet ducting into a building, the improvement comprising a heat exchanger disposed between each of the pads and the blower. Water is circulated through the heat exchanger to be cooled by the evaporatively cooled air form the pads. Ducting and associated air flow controls are provided to divert this moist cooling air from entering building occupant space. Subsequently, dry outside air is drawn through the heat exchangers to be cooled by the previously cooled water and directed into the occupant space without humidity increase. The ducting and air flow control devices are also adapted to selectably direct air from the blower to displace hot air in attic space, or to recirculate cooled air through the heat exchanger for increased cooling of the water. By circulating hot water from the building water heater through the heat exchanger, the improved air conditioning device may be used as a space heater. Air ducting and valving devices permit the improved conditioner to use hot attic or outside air to aid in heating water for subsequent use by building occupants. Otherwise wasted attic heat may be used to aid in heating of occupied space. Therefore, principal objects of the invention are to provide capability in an evaporation type air cooler to deliver cooled external air to occupant spaces without humidity increase, to utilize an evaporation type air cooling device also as a living space air heater and a water heater, and to do so economically.

BRIEF DESCRIPTION OF THE DRAWINGS

In the following drawings, which represent the best mode presently contemplated for carrying out the invention.

DETAILED DESCRIPTION OF ILLUSTRATED EMBODIMENTS

Figure 1:
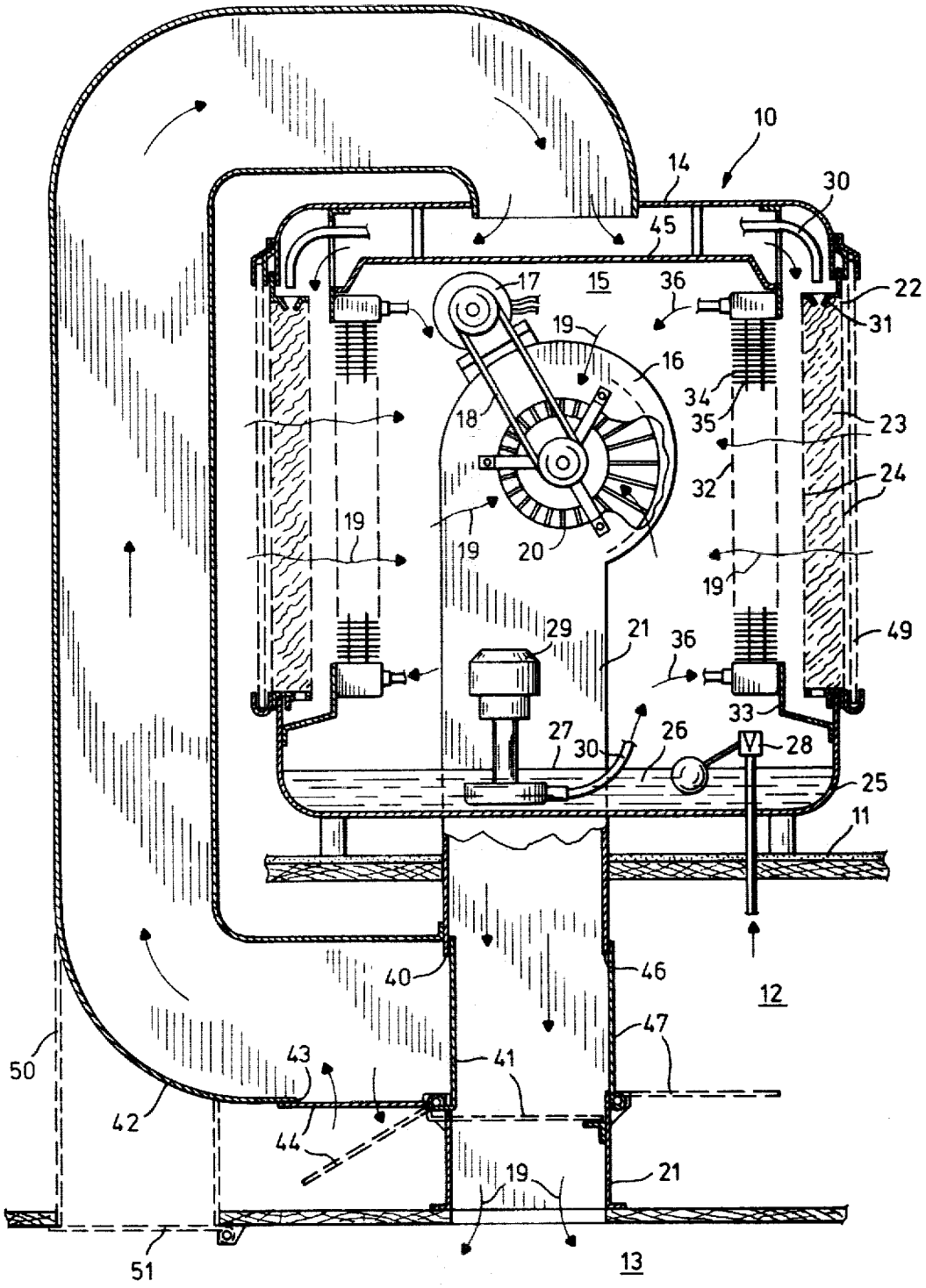
FIG. 1 is a vertical section of the air conditioner and heat dispenser.

The heat dispenser of the invention, generally 10 is shown in FIG. 1 mounted upon roof 11 of a dwelling or other building having an attic space 12 and occupant space 13. The heat dispenser 10 comprises an external housing 14 generally enclosing an inner space 15, in which is mounted an air blower 16 powered by an electric motor 17 through a flexible drive belt 18. The blower 16 draws external air, indicated by arrows 19, from the atmosphere into space 15 and thence into blower air inlet 20, and impels it through an outlet duct 21. Blower outlet duct 21 generally directs the air into an occupant space 13.

Heat dispenser 10 may be used as a conventional evaporative pad air cooler. In this event, the air 19 is cooled by evaporation upon passing through evaporation pads 22 installed in generally sealed relationship to openings provided in housing 14. The pads 22 comprise loosely packed fibers 23, of wood or other water permeable material, retained by wire netting 24. Bottom 25 of housing 14 serves as a reservoir for water 26 admitted from the building water supply and controlled to preselected level 27 by float controlled valve 28. The water 26 is impelled by pad water pump 29 through outlet hose 30 to water trough 31, by which it is distributed across pad 22 to then flow by gravity downwardly to soak fibers 23. Any excess water 26 flows from the bottom of pad 22 back into the reservoir. The air 19 is thus ordinarily cooled and made more humid by evaporative contact with water 26 upon the large surface of fibers 23, before passing into and cooling occupant space 13.

Figure 5:
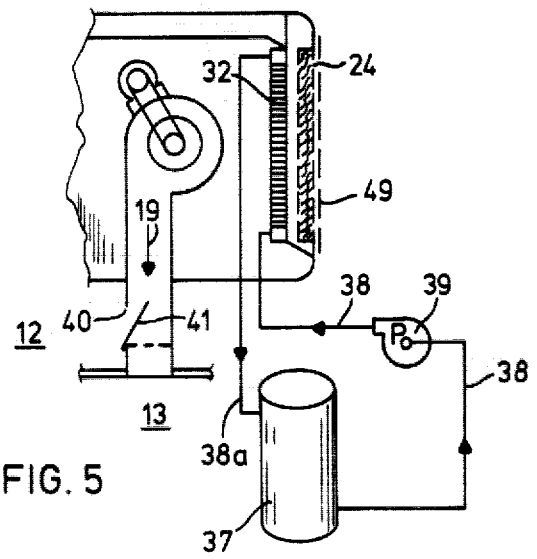

A heat exchanger 32 is mounted inside housing 14 upon mounting plates 33 which direct incoming air 19 through passages 34 between fins 35. Water 36, or other suitable heat exchange liquid, is circulated through passages, not shown, in heat exchanger 32, and is cooled by air 19, which is warmed to some extent in the process. The water 36 is stored in cold water tank 37 (FIG. 5) and circulated by water pump 39 through cold water inlet line 38 and heat exchanger 32 and through water outlet line **38*a* back to accumulate in cold water tank 37**.

During the aforesaid accumulation of cooled water 36, the air 19 from blower 16 may be allowed to flow through air duct 21 to occupant space 13. However, since this air 19 is now only partially cooled, and is moisture laden, an air diversion aperture 40 is provided communicating between attic space 12 and the interior of blower outlet duct 21. (FIG. 5) A pivoting air shutter valve 41 serves to selectively direct air 19 to the occupant space 13, to attic space 12, or partially to both spaces. The air 19 diverted to attic space 12 displaces hot air to aid in the cooling of the building. If desired, a controllable air exit vent, not shown, may be provided in duct 21 between housing 14 and roof 11, to selectively divert the air back to the external atmosphere. After sufficient cooled water 36 is accumulated in tank 37, the flow of pad water 26 is stopped by shutting off pad water pump 29, (FIG. 1) and pad 22 quickly dries by evaporation. Thereafter, incoming air 19 is cooled by the action of heat exchanger 32, and air shutter valve 41 is disposed to close aperture 40 to direct dry cooled air 19 into occupant space 13.

A return duct 42 (FIGS. 1 and 6) may be provided to communicate between duct 21 and the interior of housing 14. An opening 43 controlled by a pivoting vane 44 connects the interior of duct 21 with attic space 12. Thus, in the above described water cooling phase of operation of heat dispenser 10, air 19 may be diverted from duct 21 to recirculate through heat exchangers 32, for more efficient cooling of water 26. Baffle plate 45 directs air 19 from duct 42 to pass again through heat exchangers 32. When it is desired, as hereinabove mentioned, to direct air 19 into attic space 12, air shutter valve 41 is disposed to close return duct 42, and a side aperture 46 in duct 21, controlled by a pivoting shutter 47, is opened.

Figure 6:
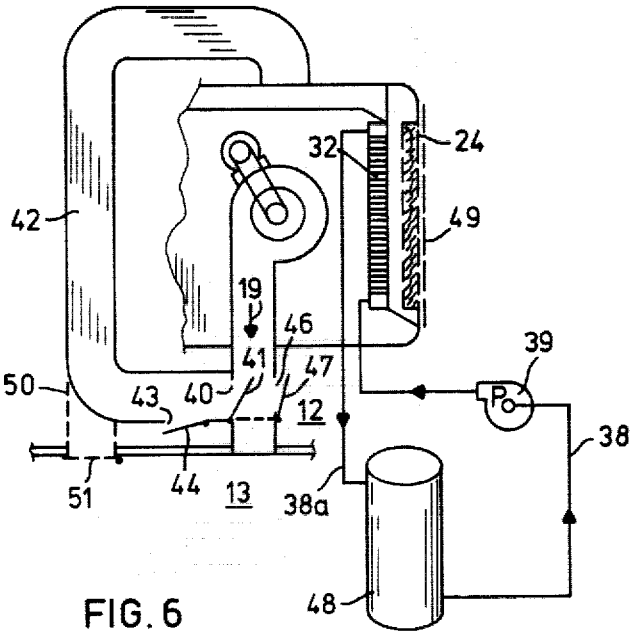

Heat dispenser 10 may also be used to provide heated air to occupant space 13 during colder nights or seasons, by providing for circulation of hot water through heat exchangers 32. See FIG. 6, showing a hot water heater 48 of the building. The pads 22 are, for this use of heat dispenser 10, not supplied with water 26 by pad water pump 29, so that incoming external air 19 is not cooled, but is heated by passage through heat exchangers 32, and then delivered to occupant space 13 through duct 21. Or, warmer air from attic space 12 may be directed to heat exchangers 32 by opening of air valve 44 in return duct 42, incoming external air 19 in this instance being blocked by external panels 49 installed over pads 22, and indicated in dashed lines in FIG. 1 and FIG. 6. This manner of use of heat dispenser 10 allows utilization of otherwise wasted heat in the attic air. Further, recirculation heating of air in occupant space 13 may be accomplished by addition of a branch duct 50, shown in dashed lines in FIG. 1 and FIG. 6, communicating between space 13 and return duct 42, and carrying controllable air valve 51.

The air return duct 42 is indicated in FIGS. 1 and 6 as entering the housing 14 by way of its top. However, in a manner easily visualized although not illustrated, one of the air blocking panels 49 could be adapted to connect with duct 42 (appropriately shortened) to provide entry of air from return duct 42 into the housing 14. In this event, adjacent sides of the heat exchangers 32 would be connected by additional baffle plates, not shown, to direct return air 19 more or less equally through the heat exchangers on each side of the housing 14. When the attic return air 19 is used for heating as above described, the panels 49 are in place blocking the entry of cold outside air 19.

Heat dispenser 10 may also be used to aid in heating water for use of building occupants, hot external air then being allowed to enter housing 14 through dry pads 22, and water from building hot water heater tank 48 being circulated through heat exchangers 32, heated thereby and returned to accumulate in tank 48. The amount of heat then needed to heat water in tank 48 for occupant use is substantially reduced. Otherwise wasted attic space heat may also be used to aid in heating water for occupant use, by use of panels 49, return duct 42 and air valve 43, as hereinbefore described.

Figure 2:
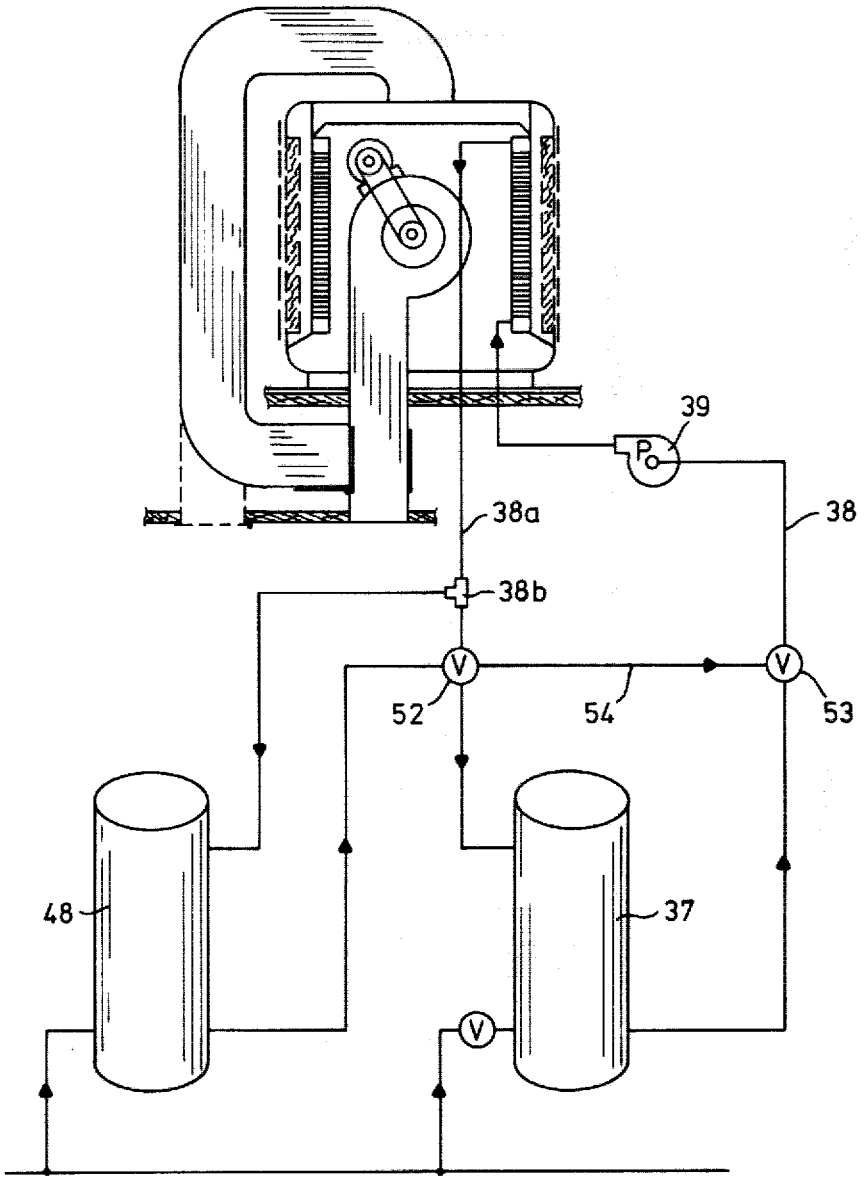
FIG. 2 a schematic drawing of the air conditioner and heat dispenser, shown installed in a building and adapted for both cooling occupant air or dispensing heat thereto.
Figure 4:
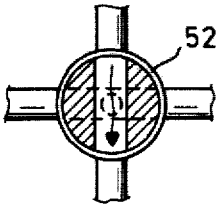
Figure 3:
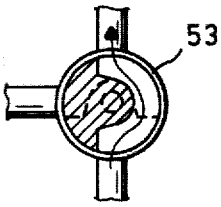
FIG. 3 a schematic representation of one of the two-way water valves of FIG. 2, FIG. 4 a schematic representation of the other of the two-way water valves of FIG. 2, FIG. 5 a schematic representation of the invention installed in a building and adapted for cooling occupant air without humidity increase, and FIG. 6 a schematic representation of the invention installed in a building and adapted to dispense heat to occupant air.

Various uses of heat dispenser 10 involving the circulation and supply of cold water and of hot water have hereinbefore been separately described. By provision of appropriate water flow controls and water piping as indicated schematically in FIG. 2, the various uses may be selected at any appropriate time in a single system. When it is desired to circulate cold water 36 from tank 37 through heat exchangers 32, water valve 53 is set to permit water to flow from tank 37. (FIG. 3). At the same time, water valve 52 is set to direct return of the water to tank 37. When water from hot water tank 48 is desired, valve 52 is set to direct water from tank 48 into cross line 54 to valve 53, which is set to direct the water then to line 38 to and through heat exchanger 32. The setting of valve 52 then directs the water through tee **38*b* and thence back to tank 48. Note that a single water pump 39 is employed for both hot and cold water. Pump 39** is preferably of the positive displacement type.

Appropriate settings of valves 52 and 53 may be effected manually, or provisions, not shown, may be made for powered, remotely signalled settings. Similarly, air shutter valves 47, 41, 44 and 51 may be manually set, or may be equipped for remotely signalled powered setting.

The embodiments herein described or illustrated are for illustrative purposes only, and the invention herein disclosed may be represented by other embodiments not shown or described without departing from the essential spirit of the invention, the bounds of which are determined by the length and breadth of the appended claims. All embodiments within said length and breadth, and all equivalents thereof, are intended to be embraced therein.

I claim:

1. In an evaporative air temperature conditioner adapted for installation to draw and impel exterior air into a building and comprising an air blower and driving means therefor, said blower having an air inlet opening and connecting with an air outlet duct generally for discharging the air into an occupant space of the building; a housing having a generally horizontal bottom member, a generally horizontal top member and upstanding side members, the side, top and bottom members being sealably connected to capture a space therewithin enclosing the blower air inlet; at least one air admitting, air permeable, water impregnable pad communicating with the exterior air and closing an opening provided therefor in at least one of the housing members; and means controllably directing water to said pad; the improvement comprising:

a heat exchanger disposed between the pad and the air inlet and having a fluid inlet and a fluid outlet and a passage therethrough connecting the fluid inlet and outlet, so that heat exchanger fluid may be circulated through the heat exchanger;

means directing cooled air from the pad to the heat exchanger; and air valving means carried by the air outlet duct directing air selectably from the blower into the occupant space or diverting said air therefrom.

2. The improvement of claim 1, further comprising:

an air valve carried by the outlet duct and directing the air selectably into the occupant space or into an attic space of the building; and wherein the heat exchanger fluid is water.

3. The improvement of claim 2, further comprising:

a tank for storing cold water;

an inlet cold water pipe for carrying cold water from the tank to the heat exchanger fluid inlet;

an outlet cold water pipe for transporting cold water from the heat exchanger fluid outlet to the tank; and a water pump for impelling water serially through the inlet cold water pipe, the heat exchanger and the outlet cold water pipe.

4. The improvement of claim 2, further comprising:

a removable panel for blocking entry of air into the air temperature conditioner by way of the pad;

an attic air duct communicating between the attic space and the interior of the conditioner housing; and a baffle inside the conditioner housing for directing attic air from the attic air duct to the side of the heat exchanger oppositely disposed from the blower air inlet.

5. The improvement of claim 2, further comprising:

a removable panel for blocking entry of air into the air temperature conditioner by way of the pad;

a duct for recirculating air, said duct communicating between the air outlet duct inside the attic space and the interior of the conditioner housing;

a controllable air valve directing air from the blower outlet duct selectably in part or in entirety into the recirculating air duct; and a baffle inside the conditioner housing for directing air from the air recirculation duct to the side of the heat exchanger oppositely disposed from the blower air inlet.

6. The improvement of claim 2, further comprising:

a duct for recirculating air, said duct communicating between the air outlet duct inside the attic space and the interior of the conditioner housing;

a controllable air valve directing air from the blower outlet duct selectably in part or in entirety into the air recirculation duct; and a baffle inside the conditioner housing directing air from the air recirculation duct to the side of the heat exchanger removed from the blower air inlet.

7. The improvement of claim 6, further comprising:

a controllable air valve communicating between the attic air space and the interior of the air recirculation duct.

8. The improvement of claim 7, further comprising:

a removable panel for blocking entry of air into the air temperature conditioner by way of the pad.

9. The improvement of claim 2, further comprising:

an inlet hot water pipe for transporting hot water from a water heater tank of the building to the heat exchanger water inlet;

an outlet hot water pipe for transporting hot water from the heat exchanger water outlet to and into the water heater tank;

a water pump for impelling water serially through the inlet hot water pipe, the heat exchanger, and the outlet hot water pipe.

10. The improvement of claim 9, further comprising:

a removable panel for blocking entry of air into the air temperature conditioner by way of the pad;

an attic air duct communicating between the attic space and interior of the conditioner housing; and a baffle inside the housing for directing air from the attic air duct to the side of the heat exchanger removed from the blower air inlet.

11. The improvement of claim 3, further comprising:

a controllable inlet two way water valve in said inlet cold water pipe between said water pump and the cold water tank, said two way inlet water valve having three pipe connecting means;

a controllable outlet two way water valve in said outlet cold water pipe, said outlet two way water valve having four pipe connecting means;

a hot water pipe communicating a water heater tank of the building with one of the pipe connection means of the outlet two way water valve;

a valve connecting hot water pipe communicating the outlet two way water valve and the inlet two way water valve;

a tee in the cold water outlet pipe between the heat exchanger water outlet and the outlet two way water valve; and a hot water return pipe connecting the tee and the hot water tank.

12. The improvement of claim 11, wherein:

the two way water valves are manually controllable.

13. The improvement of claim 8, wherein:

the controllable air valves are manually controlled.

14. The improvement of claim 4, wherein:

the attic air duct communicates with the interior of the conditioner housing through the top thereof.

15. The improvement of claim 1, wherein:

the heat exchanger is a radiator of the type used in water cooled automotive engines.

* * * * *